US011017787B2

(12) United States Patent
Freudenthal

(10) Patent No.: US 11,017,787 B2
(45) Date of Patent: May 25, 2021

(54) SELF-ADJUSTING FUNDAMENTAL FREQUENCY ACCENTUATION SUBSYSTEM FOR NATURAL EAR DEVICE

(71) Applicant: Board of Regents, The University of Texas System, Austin, TX (US)

(72) Inventor: Eric A. Freudenthal, El Paso, TX (US)

(73) Assignee: Board of Regents, The University of Texas System, Austin, TX (US)

( * ) Notice: Subject to any disclaimer, the term of this patent is extended or adjusted under 35 U.S.C. 154(b) by 232 days.

(21) Appl. No.: 16/271,237

(22) Filed: Feb. 8, 2019

(65) Prior Publication Data

US 2019/0251981 A1 Aug. 15, 2019

Related U.S. Application Data

(60) Provisional application No. 62/628,903, filed on Feb. 9, 2018.

(51) Int. Cl.
*G10L 21/013* (2013.01)
*G10L 25/90* (2013.01)

(52) U.S. Cl.
CPC ..... *G10L 21/013* (2013.01); *G10L 25/90* (2013.01); *G10L 2021/0135* (2013.01)

(58) Field of Classification Search
CPC ..... G10L 21/013; G10L 15/30; G10L 25/90; G10L 2015/225; G10L 2021/0135; H03G 3/20; H03G 3/00
USPC ..... 381/56, 61, 98, 110; 704/205, 206, 207, 704/275, 278
See application file for complete search history.

(56) References Cited

U.S. PATENT DOCUMENTS 6,410,568 B1 * 6/2002 Schastak ..... A61P 35/00 514/333
8,566,092 B2 * 10/2013 Liu ..... G10L 17/26 704/246
9,773,426 B2 * 9/2017 Freudenthal ..... G10H 1/44
2006/0178876 A1 8/2006 Sato et al.
2010/0036660 A1 * 2/2010 Bennett ..... G10L 17/26 704/231
2011/0142258 A1 * 6/2011 Beer ..... H04R 3/12 381/98
2013/0182862 A1 * 7/2013 Disch ..... G10L 21/00 381/61

(Continued)

OTHER PUBLICATIONS

Freudenthal et al., "Vocal Feedback Device and Method of Use," U.S. Appl. No. 16/271,372, filed Feb. 8, 2019, 34 pages.

(Continued)

*Primary Examiner* — Xu Mei
(74) *Attorney, Agent, or Firm* — Yee & Associates, P.C.

(57) ABSTRACT

An apparatus to accentuate a fundamental frequency of a singer's utterance. The apparatus includes a frequency discriminator configured to detect the fundamental frequency of the singer's utterance. The apparatus also includes a device configured to process the singer's utterance, the device comprising at least one of: a filter connected to the frequency discriminator and configured to isolate the fundamental frequency; or a synthesizer connected to the filter and configured to isolate the fundamental frequency. The apparatus also includes a speaker configured to emit an audio signal that effectively reproduces and accentuates the fundamental frequency back to the singer.

20 Claims, 5 Drawing Sheets

(56) References Cited

U.S. PATENT DOCUMENTS

| | | | | |
|---|---|---|---|---|
| 2014/0207443 | A1* | 7/2014 | Hosoya | G10L 21/0388 704/206 |
| 2015/0350779 | A1* | 12/2015 | McNutt | G10K 11/002 381/71.1 |
| 2018/0061431 | A1* | 3/2018 | Honig | G10L 25/66 |
| 2019/0251982 | A1* | 8/2019 | Freudenthal | G10L 21/013 |

OTHER PUBLICATIONS

Notice of Allowance, dated Nov. 16, 2020, regarding U.S. Appl. No. 16/271,372, 8 pages.

* cited by examiner

SELF-ADJUSTING FUNDAMENTAL FREQUENCY ACCENTUATION SUBSYSTEM FOR NATURAL EAR DEVICE

CROSS-REFERENCE TO RELATED APPLICATION(S)

This application claims the benefit of U.S. Provisional Patent Application No. 62/628,903 filed on Feb. 9, 2018, the contents of which are incorporated herein by reference.

BACKGROUND INFORMATION

1. Field

The present disclosure relates generally to methods and apparatus that assist a singer to sing intended notes. The illustrative embodiments particularly relate to a self-adjusting fundamental frequency accentuation (FFA) subsystem for natural ear device.

2. Background

Many people have a desire to sing, but have difficulty singing the correct pitch for music that they would like to perform. Thus, methods and devices are desirable for helping people who have difficulty matching the pitch of their voice to the correct pitch for the music to be performed.

SUMMARY

An example vocal feedback apparatus to assist a user with uttering an intended frequency including an input signal derived from a user's utterance and received by a fundamental frequency accentuator, where the user's utterance is determined by the user and corresponds to an intended fundamental frequency, a detected fundamental frequency determined from the input signal by the fundamental frequency accentuator, and an output signal generated by the fundamental frequency accentuator, where the output signal contains the detected fundamental frequency and is continually adjusted by the fundamental frequency accentuator in response to changes in the detected fundamental frequency, wherein the output signal is receivable by the user and the user adjusts the user's utterance based on a difference perceived by the user between the intended fundamental frequency and the detected fundamental frequency.

An example self-adjusting fundamental frequency accentuation natural ear apparatus includes an input transducer configured to generate an input signal from an utterance, a fundamental frequency discriminator configured to detect a fundamental frequency in the input signal and transmit a detected voice frequency signal, a device configured to accentuate the detected fundamental frequency and generate an output signal containing the accentuated fundamental frequency, and an output transducer configured to generate sound corresponding to the accentuated fundamental frequency, wherein the device automatically adjusts the accentuated fundamental frequency if the detected voice frequency changes as a result of a change in the utterance.

An example method for accentuating a fundamental frequency of a user's utterance including receiving an input signal at a fundamental frequency discriminator, where the input signal corresponds to the user's utterance, detecting a fundamental frequency of the utterance from the input signal using the fundamental frequency discriminator, accentuating the detected fundamental frequency of the user's utterance, transmitting an output signal containing the accentuated fundamental frequency to an output transducer, and producing sound from the output transducer corresponding to the accentuated fundamental frequency, where the sound is heard by the user.

BRIEF DESCRIPTION OF THE DRAWINGS

The novel features believed characteristic of the illustrative embodiments are set forth in the appended claims. The illustrative embodiments, however, as well as a preferred mode of use, further objectives and features thereof, will best be understood by reference to the following detailed description of an illustrative embodiment of the present disclosure when read in conjunction with the accompanying drawings, wherein:

DETAILED DESCRIPTION

Figure 1:
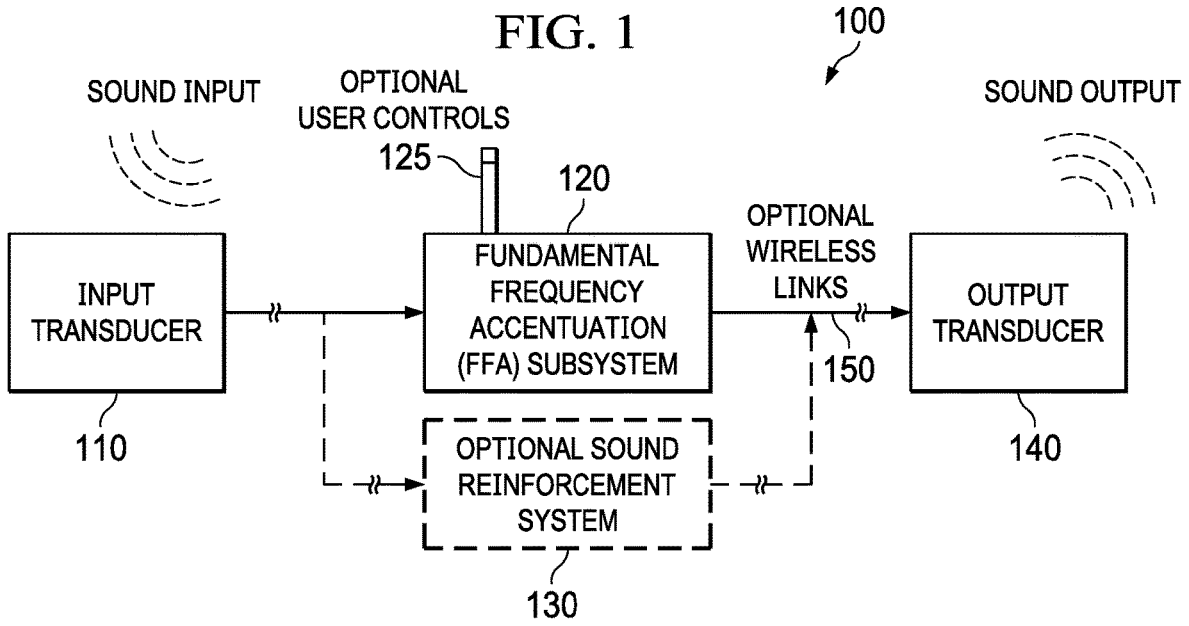
FIG. 1 depicts a fundamental frequency accentuation subsystem embedded within a full natural ear system, in accordance with an illustrative embodiment.

The illustrative embodiments recognize and take into account that the natural ear device of U.S. Pat. No. 9,773,426 to Freudenthal et al. enables people who are tonally-challenged to accurately perceive the notes they utter and sing on pitch. However, the present disclosure describes a method and apparatus to implement a self-adjusting fundamental frequency accentuation (FFA) subsystem for a natural ear device. Self-adjusting FFA subsystems can reduce or obviate the need for natural-ear systems to be calibrated to singer's characteristics prior to use and can provide feedback suitable for singing music over a wider range of frequencies than would be provided by FFAs that do not self-adjust.

Thus, the present disclosure relates generally to methods and apparatuses that assist a singer to sing intended notes. The acoustic signal from human utterances is dominated by distracting harmonics on different notes, which makes detection of the fundamental frequency very difficult for poor singers. The present disclosure describes an implementation of a self-adjusting fundamental frequency accentuation (FFA) subsystem for the natural ear (NE) device. This self-adjusting FFA subsystem eliminates or reduces the need for calibration of the natural ear's filter prior to or during use and can enable more precise and dynamically adaptive feedback to users.

The illustrative embodiments recognize and take into account that, similar to people who are "tone-deaf," "tone challenged" singers cannot or are unreliable at uttering tones that match the fundamental frequency of a tone emitted from another source or correspond to the sequence of tones of a familiar melody. However, unlike people who are "tone-deaf," those who are "tone challenged" can distinguish whether a sequence of tones emitted from an external source (e.g. another singer or musical instrument) approximates the relative sequence of tones of a familiar melody. A person's utterances are a composite of multiple frequencies, primarily consisting of a fundamental frequency and its harmonics.

People who are "tone challenged" have difficulty determining if the fundamental frequency from the spectrum of frequencies within their utterances corresponds to the frequency they intended to utter. The condition of being "tone challenged" and "tone deaf" is generally not distinguished, and is colloquially referred to as "tin ear." Thus, as an example of the "tin ear" condition, a singing instructor utters a note N and asks student singers to imitate her singing.

Singers who have neither of these conditions can hear and discern the fundamental frequency within the note they utter and can easily tune their vocal cords to emit the note N. In contrast, singers who are "tone challenged" may be able to distinguish the frequency of a reference tone at note N sung by others or played on a musical instrument. Singers who are "tone challenged" have difficulty discerning the fundamental frequency in their own utterances, and are thus unable or have difficulty singing an intended note N, even if a reference tone is available.

The natural ear device of U.S. Pat. No. 9,773,426 to Freudenthal et al. provides a method and apparatus to enable people who can discern other's pitch to sing notes at intended frequencies. A key component of the natural ear device is a filter that accentuates the fundamental frequency of a singer's utterances. This disclosure describes implementations of a self-adjusting signal filtering subsystem for the natural ear that facilitates the singer's correct identification of the fundamental frequency of his/her utterances. This self-adjusting fundamental frequency accentuation (FFA) subsystem identifies and accentuates the fundamental frequency of the singer's utterance by attenuating distracting harmonics with a filter or synthesizing a facsimile of the utterance that substantially contains the fundamental frequency of the utterance. This self-adjusting fundamental frequency accentuation (FFA) subsystem eliminates or reduces the need for calibration of the natural ear's filter prior to or during use and can provide dynamically adaptive feedback to users over a very broad range of frequencies. A natural ear device incorporating an automatic FFA subsystem may or may not require (or provide) user controls or mechanism for calibration.

Certain terms are used throughout the following description and claims to refer to particular system components and configurations. As one skilled in the art will appreciate, the same component may be referred to by different names. This document does not intend to distinguish between components that differ in name but not function.

The term "couple" or "couples" is intended to mean either an indirect or direct connection. Thus, if a first device couples to a second device, that connection can be through a direct connection, or through an indirect connection via other devices and connections.

In the field of music, a fundamental frequency f is also referred to as the first harmonic frequency H1. Similarly, the second harmonic frequency H2 is 2*H1 or 2*f third harmonic frequency H3 is 3*H1 or 3*f and so on. The fundamental frequency depicted in frequency spectrum graph of singer's voice utterances is referred to in this description as $F_u$ (uttered) for shortening of notation. The term "filtering sound" means applying a filter to modify the frequency composition of the sound.

When an input/output signal or an utterance "corresponds" to a fundamental frequency or spectrum of frequencies, it is intended to mean that the sound heard by a user resulting from the input/output signals or utterances is the vocal sound at the fundamental frequency or spectrum of frequencies. Thus, if an output signal corresponds to a particular fundamental frequency, the sound heard as a result of the output signal is the vocal sound from the user making an utterance at the particular fundamental frequency.

The foregoing description of the figures is provided for the convenience of the reader. It should be understood, however, that the embodiments are not limited to the precise arrangements and configurations shown in the figures. Also, the figures are not necessarily drawn to scale, and certain features may be shown exaggerated in scale or in generalized or schematic form, in the interest of clarity and conciseness. The same or similar parts may be marked with the same or similar reference numerals.

While various embodiments are described herein, it should be appreciated that the present invention encompasses many inventive concepts that can be embodied in a wide variety of contexts. The following detailed description of exemplary embodiments, read in conjunction with the accompanying drawings, is merely illustrative and is not to be taken as limiting the scope of the invention, as it would be impossible or impractical to include all of the possible embodiments and contexts of the invention in this disclosure. Upon reading this disclosure, many alternative embodiments of the present invention will be apparent to persons of ordinary skill in the art. The scope of the invention is defined by the appended claims and equivalents thereof.

Illustrative embodiments of the invention are described below. In the interest of clarity, not all features of an actual implementation are described in this specification. In the development of any such actual embodiment, numerous implementation-specific decisions may need to be made to achieve the design-specific goals, which can vary from one implementation to another. It will be appreciated that such a development effort, while possibly complex and time-consuming, would nevertheless be a routine undertaking for persons of ordinary skill in the art having the benefit of this disclosure.

In accordance with various embodiments of this invention, the natural ear device assists a person who is "tone challenged" by allowing him or her to distinguish the fundamental frequency of her utterance from the other harmonics present in the utterance. Thus, using the natural ear device, a "tone challenged" person can match the pitch of tones from other sources or properly sing a relative sequence of tones from a song's melody. Additionally, users have greater awareness of various aspects of their voice related to musicality including how they pronounce vowels, diction, harmonization with others, and phrasing. To the extent that speech includes modulating similar aspects of voice (pitch, volume, emphasis/attack, vowel sounds, etc), the device can increase users' awareness and intuitively improve their ability to accurately convey emotion in spoken presentation.

FIG. 1 depicts a fundamental frequency accentuation (FFA) subsystem embedded within a full natural ear system, in accordance with an illustrative embodiment. Natural ear device 100 may include optional wireless connections, optional user controls, and optional connections to a sound reinforcement system. In one illustrative embodiment, any needed amplification components are incorporated within the FFA.

FIG. 1 may be characterized as natural ear device 100 for facilitating "tone challenged" users to utter intended notes. The user utters sound into input transducer 110, for example, a microphone. In accordance with the embodiment shown in FIG. 1, input transducer 110 couples to FFA subsystem 120. Input transducer 110 may couple to FFA subsystem 120 through one of several (optional) wireless links 150. FFA subsystem 120 is coupled to output transducer 140, for example, a speaker or earbud. FFA subsystem 120 may couple to output transducer 140 through optional wireless links 150. This embodiment also incorporates links to optional sound reinforcement system 130 that can be used to (1) feed the user's voice to speakers or recording equipment and (2) enable the user to monitor other aspects of the performance. In some embodiments, multiple wireless links may be multiplexed over the same communication channel. Optional user controls 125 may be provided to manipulate various operational characteristics of natural ear device 100, for example, amplitude (volume) of the signal provided to output transducer 140.

In accordance with other embodiments, input transducer 110 and/or output transducer 140 can couple to FFA subsystem 120 through wired connections (not shown in FIG. 1), and sound reinforcement system 130 may be omitted. Furthermore, amplification functions and/or codecs may be incorporated within any or all components.

Figure 2:
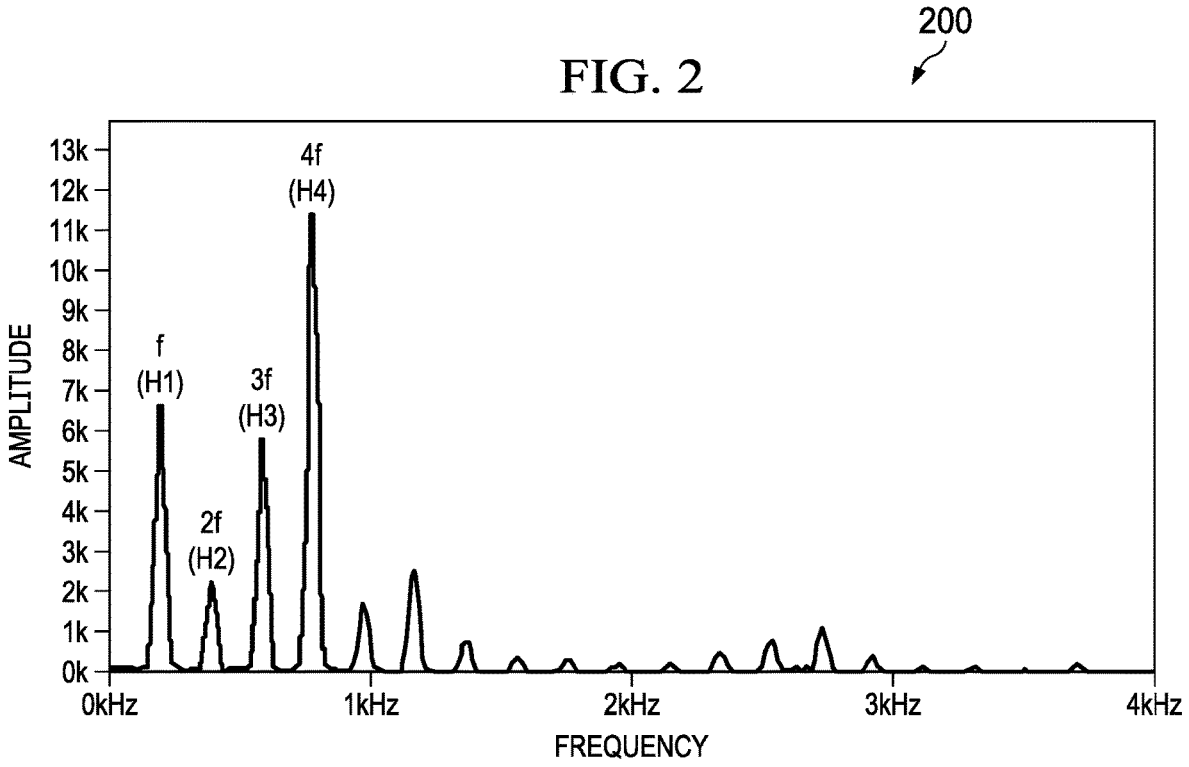
FIG. 2 is a graph of the frequency spectrum of a singer's voice, in accordance with an illustrative embodiment.

FIG. 2 is a graph of the frequency spectrum of a user's voice, in accordance with an illustrative embodiment. The user's voice may be that described with respect to FIG. 1.

In FIG. 2, an exemplary frequency spectrum graph 200 of a user's utterances is illustrated. Frequency spectrum graph 200 shows the user's utterances contain a fundamental frequency component f, second harmonic 2f, third harmonic 3f, fourth harmonic 4f, and so on until the amplitude of the harmonics become very small. In this illustration, after the sixth harmonic, the amplitude approaches close to zero. A user's utterances have harmonious and unharmonious frequency components. The unharmonious components are frequently perceived to provide richness and depth to an on-pitch voice. Skilled users learn to control and exploit those components to convey musical depth and color.

The fundamental frequency f and some harmonics including 2f and 4f are harmonious. Odd harmonics such as 3f, 5f, 7f and so on are particularly unharmonious. As explained above, users who are "tone challenged" cannot clearly discern the fundamental frequency of a note in their own utterances due to the associated and coincidental harmonics. "Tone challenged" users frequently 1) improperly identify one or more odd harmonics as the fundamental frequency of the note and/or 2) are unable to discern the fundamental frequency that they are uttering. Thus, in FIG. 2 a "tone challenged" user might identify the loud odd harmonic 3f as their fundamental frequency and believe that this unharmonious odd harmonic is their fundamental frequency, which is undesirable.

The natural ear device as described in this disclosure creates an artificial acoustic path from the mouth to ear that accentuates and amplifies the fundamental frequency. In accordance with some exemplary embodiments of this disclosure including a digital signal processor, the natural ear device can accentuate and amplify the fundamental frequency uttered by the user.

Figure 3:
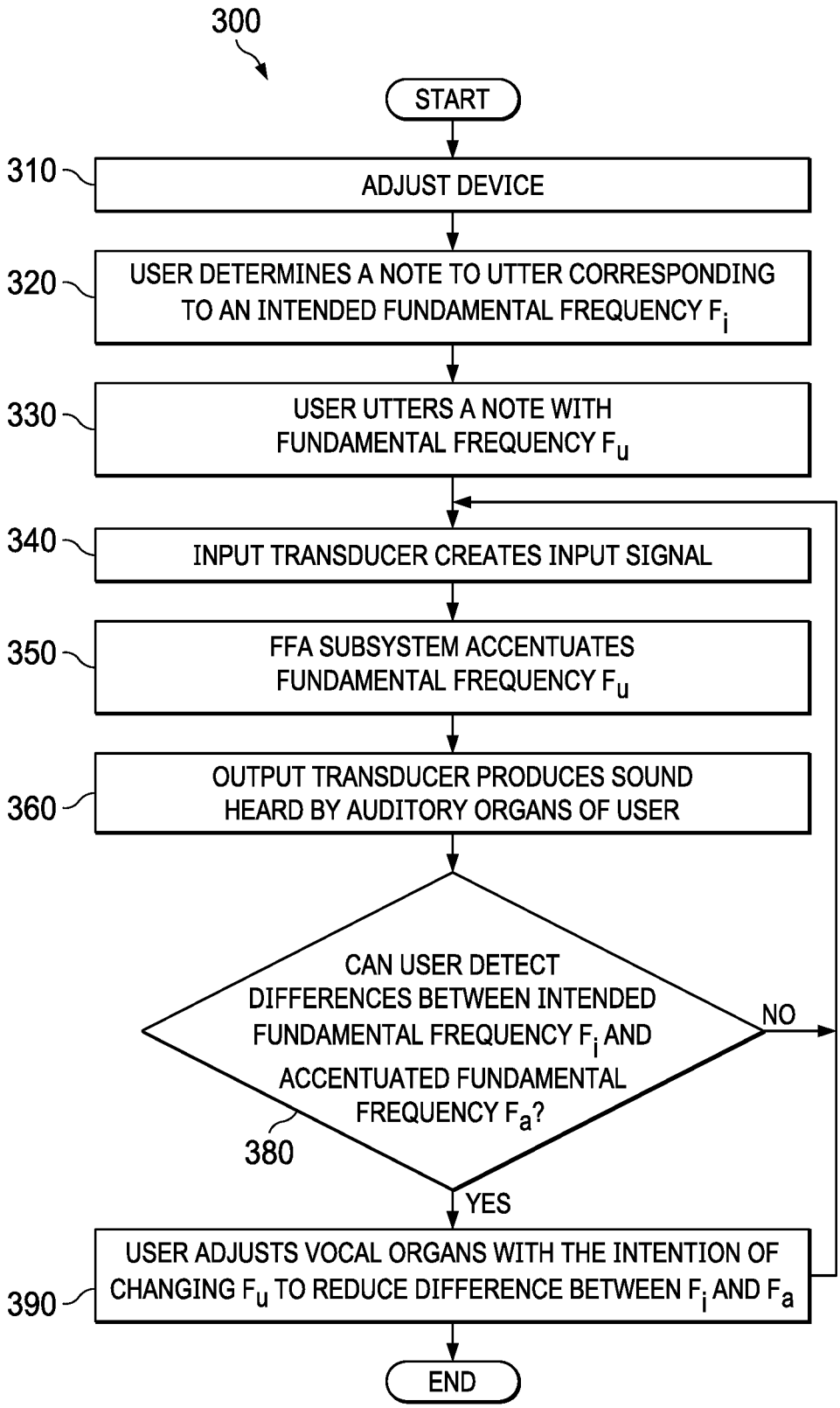
FIG. 3 depicts a process for using and operating the natural ear device having a fundamental frequency accentuation subsystem embedded within, in accordance with an illustrative embodiment.

FIG. 3 depicts a process for using and operating the natural ear device having a fundamental frequency accentuation subsystem, in accordance with an illustrative embodiment. Process 300 may be implemented using a system, such as natural ear device 100 in FIG. 1.

FIG. 3 depicts a process for using and operating natural ear device 100. In operation 310, in accordance with some embodiments of the present disclosure, natural ear device 100 is adjusted for user comfort before the user begins uttering. Adjustments may include frequency range, include volume levels, and fitting of, for example, headphones and/or earbuds to the user.

At operation 320, the user determines a note to sing/utter at an intended fundamental frequency $F_i$ (intended). The intended fundamental frequency $F_i$ may be the result of, for example, hearing an instructor sing, hearing a note of a song, hearing a musical instrument, the next note in a familiar melody, etc. In operation 330, the user utters a note at fundamental frequency $F_u$ (uttered) using their vocal organs, particularly their primary vocal cords. An utterance at $F_u$ has a frequency spectrum with fundamental frequency $F_u$ and harmonics of $F_u$ at integer multiples of $F_u$ at various amplitudes. Fundamental frequency $F_i$ is the basis for fundamental frequency $F_u$. The user intends to utter fundamental frequency $F_i$ but in practice actually utters fundamental frequency $F_u$. As the natural ear device 100 processes the sound in operations 340-390, the user is continuously uttering the note and does not stop.

At operation 340, input transducer 110 creates an input signal derived from the full frequency spectrum of the user's utterance of a note at fundamental frequency $F_u$.

In operation 350, FFA subsystem 120 receives the input signal from input transducer 110 and accentuates the fundamental frequency $F_u$, creating accentuated fundamental frequency $F_a$. In operation, the value of uttered fundamental frequency $F_u$ equals the value of accentuated fundamental frequency $F_a$. When FFA subsystem 120 accentuates the fundamental frequency $F_u$, the fundamental frequency and any other remaining frequencies (that have not been filtered out or have not been synthesized) in the uttered note are amplified such that the ratio of the effective amplitude of the accentuated fundamental frequency $F_a$ to the other frequencies of the accentuated uttered note is higher than the ratio of the effective amplitude of the fundamental frequency $F_u$ to the other frequencies of the uttered note before the accentuating occurs. FFA subsystem 120 attenuates distracting harmonics from the uttered frequency spectrum so that the distracting harmonics do not contribute significantly to the output signal transmitted by FFA subsystem 120 to an output transducer. The end result is that, in practice, the user can more easily identify the uttered fundamental frequency $F_u$ because FFA subsystem 120 generates an output signal based on an attenuated frequency spectrum of the user's uttered note that includes accentuated fundamental frequency $F_a$.

In the next operation 360, output transducer 140 receives the output signal based on the user's accentuated uttered note from FFA subsystem 120 and produces sound corresponding to the attenuated frequency spectrum including accentuated fundamental frequency $F_a$. The sound is heard by the auditory organs of the user. Next, at operation 380, a determination is made by the user whether the user can detect differences between intended fundamental frequency $F_i$ and the accentuated fundamental frequency $F_a$. Because uttered fundamental frequency $F_u$ is accentuated, the user has enhanced abilities to determine any differences between intended fundamental frequency $F_i$ and uttered fundamental frequency $F_u$ (as heard by the user via the output signal based on the attenuated frequency spectrum and the accentuated fundamental frequency $F_a$). If the user does not detect differences between intended fundamental frequency $F_i$ and accentuated fundamental frequency $F_a$ (a "no" determination at operation 380), the user continues to utter the note and the process loops back to operation 340. When the user does not detect differences between intended fundamental frequency $F_i$ and accentuated fundamental frequency $F_a$, uttered fundamental frequency $F_u$ generally matches intended fundamental frequency $F_i$. If the user does detect differences between the intended fundamental frequency $F_i$ and accentuated fundamental frequency $F_a$ (a "yes" determination at operation 380), the process proceeds to operation 390.

In operation 390, as the user continues to utter the note, the user adjusts their vocal organs with the intention of changing uttered fundamental frequency $F_u$ to reduce the perceived difference between intended fundamental frequency $F_i$ and accentuated fundamental frequency $F_a$. The process may terminate thereafter.

In accordance with some embodiments, the disclosed natural ear apparatus and process of use can assist a user to better comprehend the fundamental frequency f and other aspects of their utterances, including assisting them in learning to match frequency and other aspects of others' voices.

Figure 4:
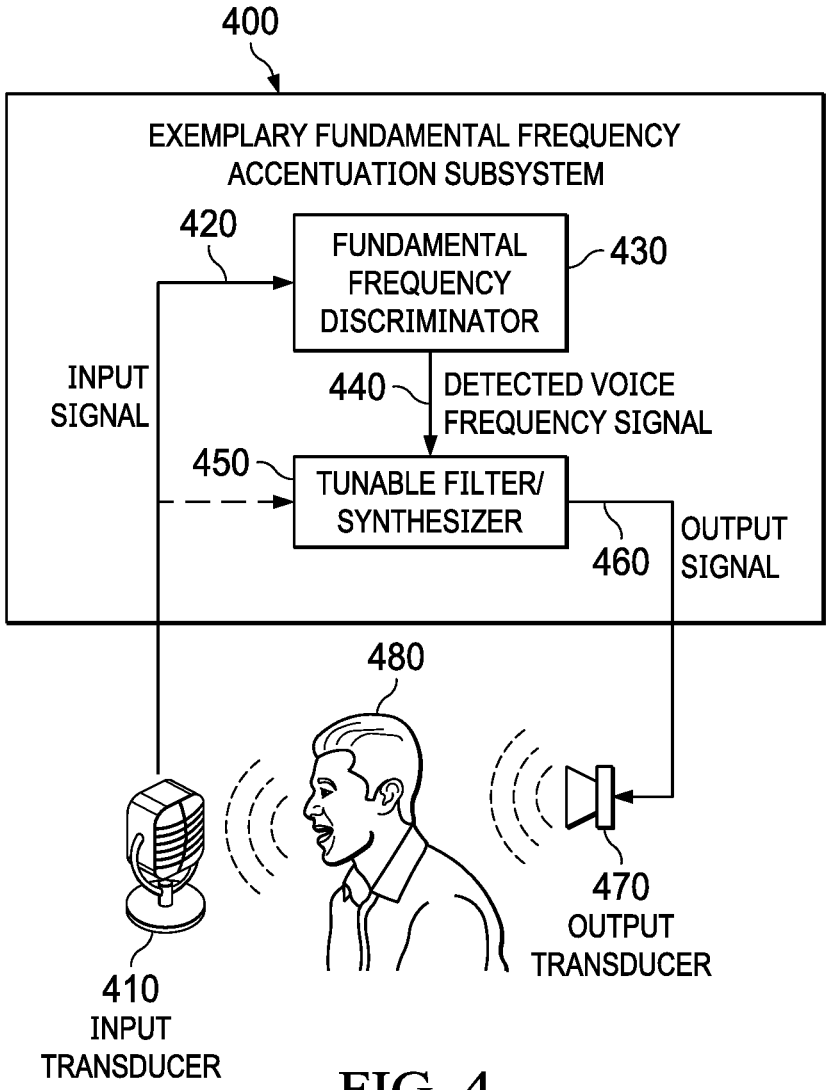
FIG. 4 depicts an exemplary fundamental frequency accentuation subsystem as connected within an implementation of a natural ear device including major subsystems, in accordance with an illustrative embodiment.

FIG. 4 depicts an exemplary fundamental frequency accentuation (FFA) subsystem as connected within an implementation of a natural ear device including major subsystems, in accordance with an illustrative embodiment. In this implementation, any amplification functions are incorporated within the FFA and no user controls are provided.

FIG. 4 reflects an exemplary embodiment of an FFA subsystem embedded within a minimal natural ear device. FFA subsystem 400 comprises fundamental frequency discriminator 430 coupled to tunable filter/synthesizer 450. Input transducer 410, for example a microphone, is coupled to fundamental frequency discriminator 430 and optionally to tunable filter/synthesizer 450. Optionally, the coupling between input transducer 410 and fundamental frequency discriminator 430 and the coupling between input transducer 410 and tunable filter/synthesizer 450 may be wireless. Tunable filter/synthesizer 450 is coupled to output transducer 470, for example, a speaker, headphones, or earbuds. Optionally, the coupling between tunable filter/synthesizer 450 and output transducer 470 may be wireless.

In use, as shown in FIG. 4, user 480 utters into input transducer 410. The user's utterance is sensed by input transducer 410 and input transducer 410 transmits input signal 420 to fundamental frequency discriminator 430. Fundamental frequency discriminator 430 detects the fundamental frequency of input signal 420 and potentially other attributes of the input signal such as amplitude and generates detected voice frequency signal 440. Detected voice frequency signal 440 is emitted by fundamental frequency discriminator 430 and conveyed to the tuning input of tunable filter/synthesizer 450. Detected voice frequency signal 440 corresponds to the fundamental frequency of the user's utterance determined by fundamental frequency discriminator 430. Tunable filter/synthesizer 450 receives detected voice frequency signal 440. Tunable filter/synthesizer 450 synthesizes a tone at the detected fundamental frequency supplied by fundamental frequency discriminator 430 and detected voice frequency signal 440. The tone is a facsimile of the user's utterance that contains an accentuated fundamental frequency that matches the detected fundamental frequency. Tunable filter/synthesizer 450 generates output signal 460. Output signal 460 corresponds to accentuated fundamental frequency $F_a$ originating from uttered fundamental frequency $F_u$. Tunable filter/synthesizer 450 automatically adjusts the synthesized tone based on the detected fundamental frequency received from frequency discriminator 430 via detected voice frequency signal 440. Tunable filter/synthesizer 450 continually receives detected voice frequency signal 440 for as long as the user utters into input transducer 410. Tunable filter/synthesizer 450 can continually adjust the synthesized tone without manual input as the detected fundamental frequency received from fundamental frequency discriminator 430 via detected voice frequency signal 440 changes. The ability to continually adjust the synthesized tone without manual input continually adjusts output signal 460. Tunable filter/synthesizer 450 transmits output signal 460 to output transducer 470. Output signal 460 substantially contains the accentuated fundamental frequency of the user's utterances. Output transducer 470 receives output signal 460 and produces sound heard by the user.

Optionally, input signal 420 may be transmitted from input transducer 410 to tunable filter/synthesizer 450 while also being transmitted to fundamental frequency discriminator 430. In this exemplary implementation of FFA subsystem 400, tunable filter/synthesizer 450 may act as a tunable low-pass or band-pass filter having a cutoff frequency or a band-pass frequency range determined from detected voice frequency signal 440. The low-pass filter of tunable filter/synthesizer 450 is automatically tuned to a cutoff frequency set slightly above the detected fundamental frequency (as determined by fundamental frequency discriminator 430). Tunable filter/synthesizer 450 continually receives detected voice frequency signal 440 for as long as the user utters into input transducer 410. Tunable filter/synthesizer 450 can continually adjust the cutoff frequency or range frequency without manual input as the detected fundamental frequency received from fundamental frequency discriminator 430 via detected voice frequency signal 440 changes. The ability to continually adjust the cutoff frequency or range frequency without manual input continually adjusts output signal 460. In this exemplary implementation of FFA subsystem 400, tunable filter/synthesizer 450, attenuates distracting harmonics from the frequency spectrum such that output signal 460 substantially contains the accentuated fundamental frequency of the user's utterance. Output signal 460 corresponds to accentuated fundamental frequency $F_a$ originating from (and equal to) uttered fundamental frequency $F_u$.

When FFA subsystem 400 accentuates the fundamental frequency, the fundamental frequency and any other remaining frequencies in the uttered note are amplified such that the ratio of the amplitude of the accentuated fundamental frequency $F_u$ to the other frequencies of the accentuated uttered note corresponding to the output signal is higher than the ratio of the amplitude of the fundamental frequency $F_u$ to the other frequencies of the uttered note corresponding to the input signal before the accentuating occurs.

In accordance with some exemplary embodiments of FFA subsystem 400, fundamental frequency discriminator 430 and tunable filter/synthesizer 450 may be integrated in a manner that some or all components serve both purposes. Fundamental frequency discriminator 430 and tunable filter/synthesizer 450 may share substantial circuitry to the extent that some previously discussed functions associated with one particular component may be associated with either component. For example, a bank of multiple low-pass or band-pass filters covering the full vocal range could drive a discrimination circuit that characterizes the frequency range of the detected utterance from the relative amplitudes of the individual filters' outputs. The FFA subsystem's output signal could be driven from a multiplexer (or signal mixer) that selects or combines the output from one or more of the filters.

Detected voice frequency signal 440 may also incorporate other attributes of the user's utterances such as volume, and this information may affect the behavior of tunable filter/synthesizer 450. For example, the amplitude (volume) of tunable filter/synthesizer 450 may be muted when no voice is detected.

In some designs of tunable filter/synthesizer 450, abrupt changes in frequency tuning may result in distracting audio artifacts such as clicking. In some implementations, these effects may be mitigated by limiting the rate that detected voice frequency signal 440 is permitted to change.

Furthermore, fundamental frequency discriminator 430 or tunable filter/synthesizer 450 or the entire FFA subsystem 400 may be implemented using a digital signal processor (DSP) or general-purpose microprocessor that can digitally process the sound signals from input transducer 410. The general-purpose microprocessor, in conjunction with an analog-to-digital (A/D) converter, digital-to-analog (D/A) converter, and analog circuitry, can retain and amplify the fundamental frequency and even harmonics of the singer's voice while selectively suppressing or enhancing other harmonics. For example, the digital signal processor can be TEXAS INSTRUMENTS® TMS320C5535 or TMS320C6455 DSP or similar DSP implementing the functionality of the amplifier and filter. As described in greater detail below, a DSP or microprocessor implementation can allow such features as auto calibration, surrounding noise reduction and auto volume adjust to further clarify and enhance the fundamental frequency and possibly some even harmonics in the singer's voice. Finally, detected voice frequency signal 440 and other signals may also be conveyed to other monitoring, instructional, and/or recording equipment.

Figure 5:
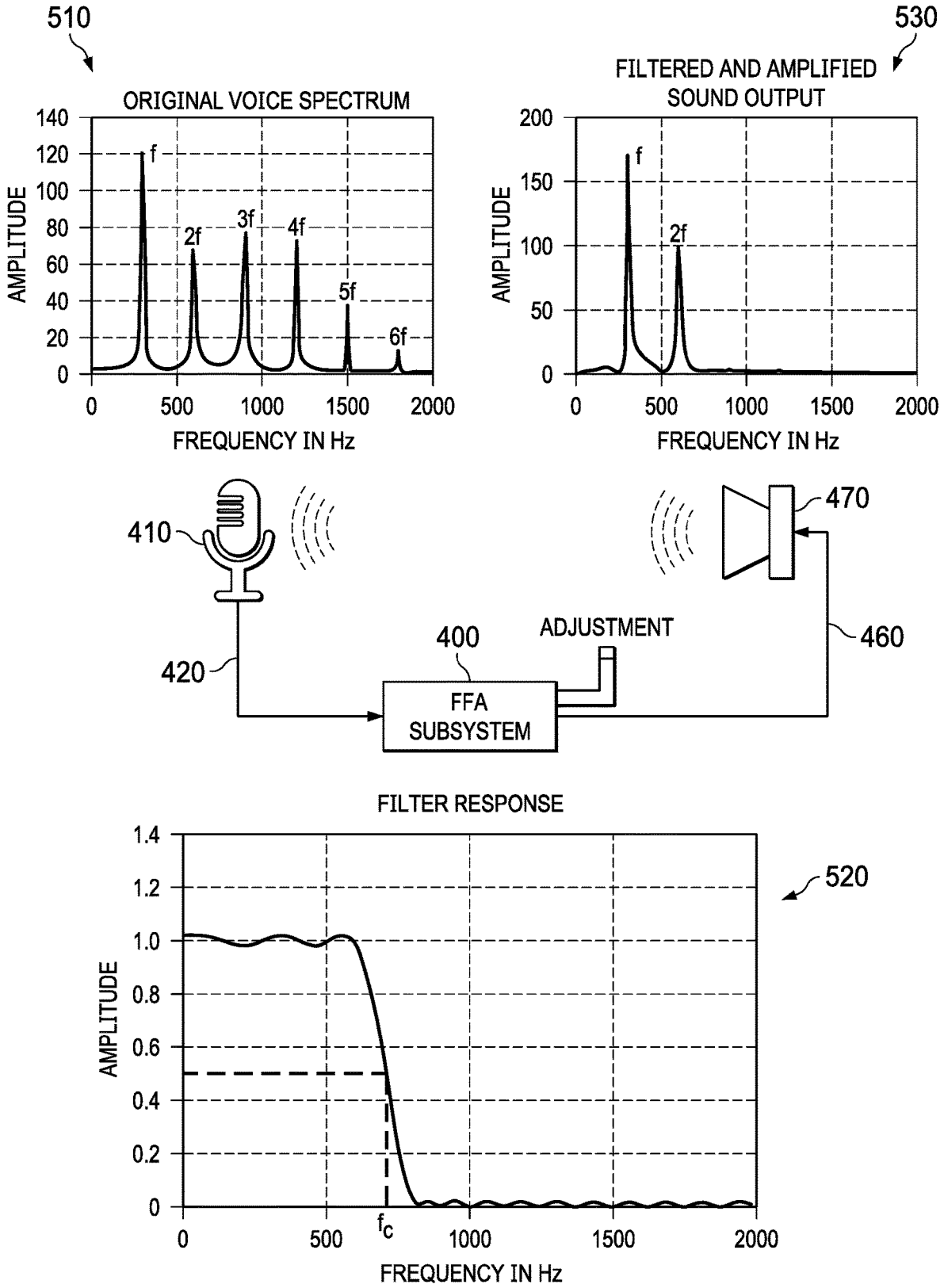
FIG. 5 illustrates amplitude versus frequency graphs of sound at input and output transducers and the fundamental frequency accentuation subsystem response, in accordance with an illustrative embodiment.

FIG. 5 illustrates amplitude versus frequency graphs of sound at input and output transducers and the low-pass filter response of FFA subsystem 400, in accordance with an illustrative embodiment. The graphs in FIG. 5 may be generated based on data taken using devices such as those described in FIG. 1 or FIG. 4.

FIG. 5 illustrates operation of an exemplary embodiment of FFA subsystem 400 of FIG. 4 including the frequency spectrum of the sound at the microphone and speaker. FIG. 5 also depicts the cutoff frequency response 520 of FFA subsystem 400 in accordance with some embodiments. In FIG. 5, one user's original voice spectrum 510 is depicted. This user's voice spectrum includes a fundamental frequency component, f, at 300 Hz and harmonics at 2f (600 Hz), 3f (900 Hz), 4f (1200 Hz), 5f (1500 Hz) and 6f (1800 Hz). The fundamental frequency component has an approximate amplitude of 120 and second harmonic 2f has an approximate amplitude of 65. The frequency response 520 approximates one, that is pass through of the signal at the filter input to its output, up to a cutoff frequency f of approximately 700 Hz. The cutoff frequency f, defines the boundary between frequencies that are accentuated versus frequencies that are attenuated. In accordance with some embodiments of this disclosure, the cutoff frequency of FFA subsystem 400 is determined during calibration of the natural ear device for the user as described above. In accordance with other embodiments, a cutoff frequency range can be set during manufacture of the natural ear device for fundamental frequencies over a certain range. Thus, natural ear devices sold to the public can specify on the packaging a range of fundamental frequencies to accommodate different people's utterances.

Referring to the sound output in output transducer 470 of FIG. 5, the frequency spectrum of the filtered and amplified output sound 530 is illustrated. Original voice spectrum 510 is low-pass filtered and amplified in FFA subsystem 400 to generate the filtered and amplified sound 530 at output transducer 470. The amplitude of the fundamental frequency component f at 300 Hz is approximately 170 and louder than the second harmonic at 2f (600 Hz) at approximately 100. An optional volume adjustment implemented through the use of the optional user controls may affect the amplitudes. All other harmonics (3f, 4f, 5f, 6f, and so on) are attenuated by FFA subsystem 400 to not contribute significantly to output signal 460 provided to output transducer 470. Thus, the user hears the harmonious amplified fundamental frequency f and second harmonic 2f and is able to compare this sound to the sound they desire at their intended fundamental frequency.

Input signal 420 from input transducer 410 is transmitted to the amplifier and low-pass filter of FFA subsystem 400. The amplifier and low-pass filter of FFA subsystem 400 accentuates and amplifies the fundamental frequency while suppressing or cutting off other distracting harmonics. An adjustment is present on the amplifier to increase the volume of the fundamental frequency. Output signal 460 is transmitted to output transducer 470 from FFA subsystem 400. Output transducer 470 produces sound into the user's ears that accentuates the harmonious amplified fundamental frequency and second harmonic such that the user is able to compare this sound to the sound they desire at their intended fundamental frequency.

Exemplary embodiments of the application processor, mobile radio subsystem, and audio codec subsystem for implementation of the natural ear device are shown and described in "Unleashing the Audio Potential of Smartphones: Dedicated Audio ICs Like Smart Audio Codecs and Hybrid Class-D Amplifiers Can Help Solve System Level Challenges" by Rob Kratsas, Cirrus Logic, Inc., Austin, Tex. . . . http://www.cirrus.com/en/pubs/whitePaper/smartphones wip.pdf incorporated herein by reference in its entirety.

The natural ear device including an FFA subsystem as described in the embodiments of this disclosure assist singers who have difficulty discerning which frequency in a note is the fundamental frequency or correct frequency when they are singing. The natural ear device has been tested on a singer. The device was placed on the singer's ear, adjusting the volume of the device for comfort and depending on the singer's need. Generally, the more the singer has difficulty in matching the note, the higher the volume can be adjusted and more filtering can be added. The singer using the natural ear device had an instant improvement in their frequency matching and became more self-aware of how they blended and balanced with other singers who sang with them.

In accordance with the embodiments described in this disclosure, the natural ear apparatus provides the ability to clearly hear and discern the fundamental frequency of one's own voice and minimizes confusion due to modifications in spectra caused by the bones, sinuses, tissue, etc., inside of the head. Filtering present in the natural ear device attenuates or removes distractions present in the pitch itself, limiting the overtones that are produced, and reducing the sound to its formant, or fundamental frequency.

Figure 6:
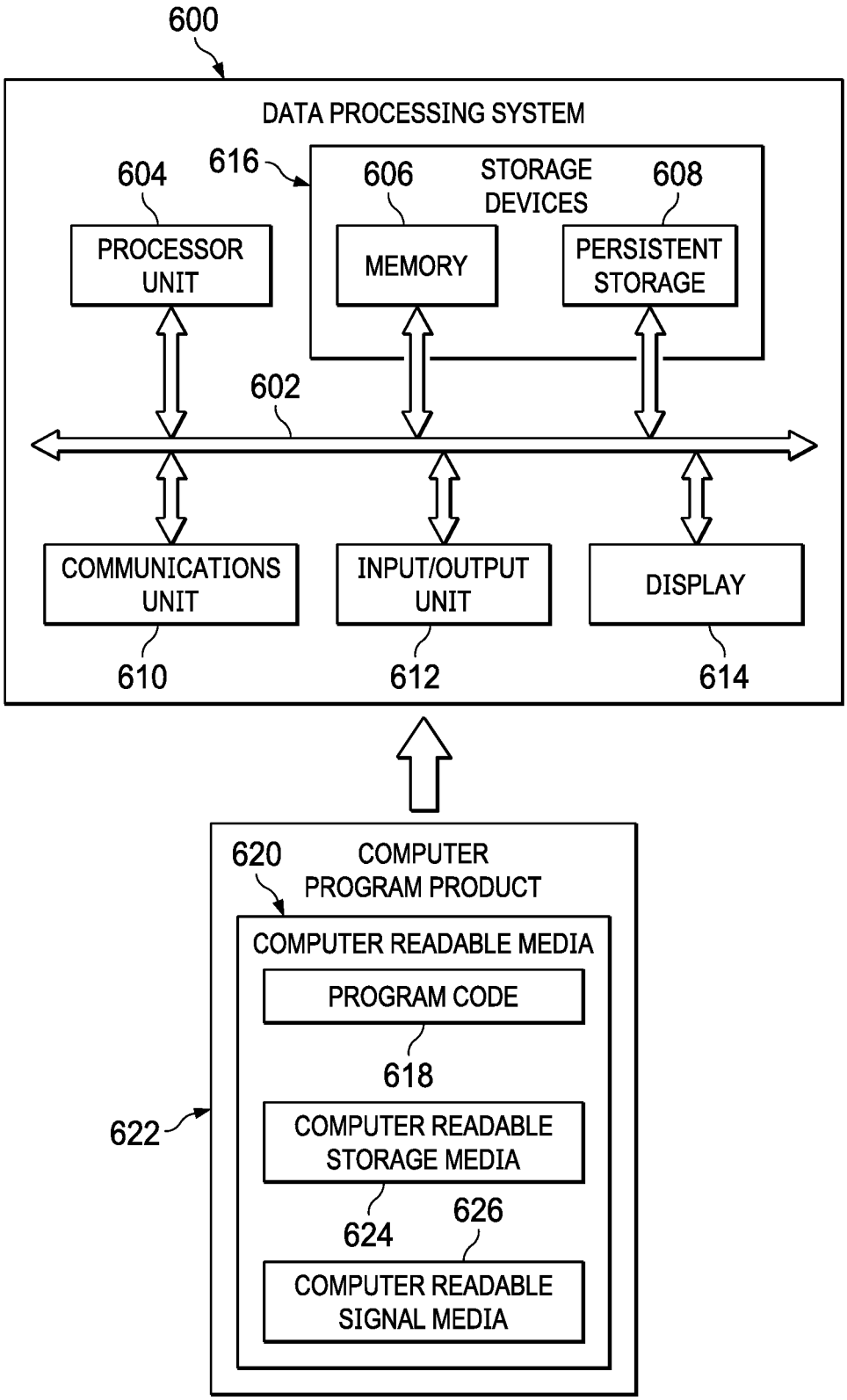
FIG. 6 illustrates a data processing system, in accordance with an illustrative embodiment.

Turning now to FIG. 6, an illustration of a data processing system is depicted in accordance with an illustrative embodiment. Data processing system 600 in FIG. 6 is an example of a data processing system that may be used to implement the illustrative embodiments, such as those described above. In this illustrative example, data processing system 600 includes communications fabric 602, which provides communications between processor unit 604, memory 606, persistent storage 608, communications unit 610, input/output (I/O) unit 612, and display 614.

Processor unit 604 serves to execute instructions for software that may be loaded into memory 606. Processor unit 604 may be a number of processors, a multi-processor core, or some other type of processor, depending on the particular implementation. A number, as used herein with reference to an item, means one or more items. Further, processor unit 604 may be implemented using a number of heterogeneous processor systems in which a main processor is present with secondary processors on a single chip. As another illustrative example, processor unit 604 may be a symmetric multi-processor system containing multiple processors of the same type.

Memory 606 and persistent storage 608 are examples of storage devices 616. A storage device is any piece of hardware that is capable of storing information, such as, for example, without limitation, data, program code in functional form, and/or other suitable information either on a temporary basis and/or a permanent basis. Storage devices 616 may also be referred to as computer readable storage devices in these examples. Memory 606, in these examples, may be, for example, a random access memory or any other suitable volatile or non-volatile storage device. Persistent storage 608 may take various forms, depending on the particular implementation.

For example, persistent storage 608 may contain one or more components or devices. For example, persistent storage 608 may be a hard drive, a flash memory, a rewritable optical disk, a rewritable magnetic tape, or some combination of the above. The media used by persistent storage 608 also may be removable. For example, a removable hard drive may be used for persistent storage 608.

Communications unit 610, in these examples, provides for communications with other data processing systems or devices. In these examples, communications unit 610 is a network interface card. Communications unit 610 may provide communications through the use of either or both physical and wireless communications links.

Input/output (I/O) unit 612 allows for input and output of data with other devices that may be connected to data processing system 600. For example, input/output (I/O) unit 612 may provide a connection for user input through a keyboard, a mouse, and/or some other suitable input device. Further, input/output (I/O) unit 612 may send output to a printer. Display 614 provides a mechanism to display information to a user.

Instructions for the operating system, applications, and/or programs may be located in storage devices 616, which are in communication with processor unit 604 through communications fabric 602. In these illustrative examples, the instructions are in a functional form on persistent storage 608. These instructions may be loaded into memory 606 for execution by processor unit 604. The processes of the different embodiments may be performed by processor unit 604 using computer implemented instructions, which may be located in a memory, such as memory 606.

These instructions are referred to as program code, computer usable program code, or computer readable program code that may be read and executed by a processor in processor unit 604. The program code in the different embodiments may be embodied on different physical or computer readable storage media, such as memory 606 or persistent storage 608.

Program code 618 is located in a functional form on computer readable media 620 that is selectively removable and may be loaded onto or transferred to data processing system 600 for execution by processor unit 604. Program code 618 and computer readable media 620 form computer program product 622 in these examples. In one example, computer readable media 620 may be computer readable storage media 624 or computer readable signal media 626. Computer readable storage media 624 may include, for example, an optical or magnetic disk that is inserted or placed into a drive or other device that is part of persistent storage 608 for transfer onto a storage device, such as a hard drive, that is part of persistent storage 608. Computer readable storage media 624 also may take the form of a persistent storage, such as a hard drive, a thumb drive, or a flash memory, that is connected to data processing system 600. In some instances, computer readable storage media 624 may not be removable from data processing system 600.

Alternatively, program code 618 may be transferred to data processing system 600 using computer readable signal media 626. Computer readable signal media 626 may be, for example, a propagated data signal containing program code 618. For example, computer readable signal media 626 may be an electromagnetic signal, an optical signal, and/or any other suitable type of signal. These signals may be transmitted over communications links, such as wireless communications links, optical fiber cable, coaxial cable, a wire, and/or any other suitable type of communications link. In other words, the communications link and/or the connection may be physical or wireless in the illustrative examples.

In some illustrative embodiments, program code 618 may be downloaded over a network to persistent storage 608 from another device or data processing system through computer readable signal media 626 for use within data processing system 600. For instance, program code stored in a computer readable storage medium in a server data processing system may be downloaded over a network from the server to data processing system 600. The data processing system providing program code 618 may be a server computer, a client computer, or some other device capable of storing and transmitting program code 618.

The different components illustrated for data processing system 600 are not meant to provide architectural limitations to the manner in which different embodiments may be implemented. The different illustrative embodiments may be implemented in a data processing system including components in addition to or in place of those illustrated for data processing system 600. Other components shown in FIG. 6 can be varied from the illustrative examples shown. The different embodiments may be implemented using any hardware device or system capable of running program code. As one example, the data processing system may include organic components integrated with inorganic components and/or may be comprised entirely of organic components excluding a human being. For example, a storage device may be comprised of an organic semiconductor.

In another illustrative example, processor unit 604 may take the form of a hardware unit that has circuits that are manufactured or configured for a particular use. This type of hardware may perform operations without needing program code to be loaded into a memory from a storage device to be configured to perform the operations.

For example, when processor unit 604 takes the form of a hardware unit, processor unit 604 may be a circuit system, an application specific integrated circuit (ASIC), a programmable logic device, or some other suitable type of hardware configured to perform a number of operations. With a programmable logic device, the device is configured to perform the number of operations. The device may be reconfigured at a later time or may be permanently configured to perform the number of operations. Examples of programmable logic devices include, for example, a programmable logic array, programmable array logic, a field programmable logic array, a field programmable gate array, and other suitable hardware devices. With this type of implementation, program code 618 may be omitted because the processes for the different embodiments are implemented in a hardware unit.

In still another illustrative example, processor unit 604 may be implemented using a combination of processors found in computers and hardware units. Processor unit 604 may have a number of hardware units and a number of processors that are configured to run program code 618. With this depicted example, some of the processes may be implemented in the number of hardware units, while other processes may be implemented in the number of processors.

As another example, a storage device in data processing system 600 is any hardware apparatus that may store data. Memory 606, persistent storage 608, and computer readable media 620 are examples of storage devices in a tangible form.

In another example, a bus system may be used to implement communications fabric 602 and may be comprised of one or more buses, such as a system bus or an input/output bus. Of course, the bus system may be implemented using any suitable type of architecture that provides for a transfer of data between different components or devices attached to the bus system. Additionally, a communications unit may include one or more devices used to transmit and receive data, such as a modem or a network adapter. Further, a memory may be, for example, memory 606, or a cache, such as found in an interface and memory controller hub that may be present in communications fabric 602.

As used herein, the term "entity" refers to an object that has a distinct, separate existence, though such existence need not be a material existence. Thus, abstractions and legal constructs may be regarded as entities. As used herein, an entity need not be animate. Associative memories work with entities.

The different illustrative embodiments can take the form of an entirely hardware embodiment, an entirely software embodiment, or an embodiment containing both hardware and software elements. Some embodiments are implemented in software, which includes but is not limited to forms such as, for example, firmware, resident software, and microcode.

Furthermore, the different embodiments can take the form of a computer program product accessible from a computer usable or computer readable medium providing program code for use by or in connection with a computer or any device or system that executes instructions. For the purposes of this disclosure, a computer usable or computer readable medium can generally be any tangible apparatus that can contain, store, communicate, propagate, or transport the program for use by or in connection with the instruction execution system, apparatus, or device.

The computer usable or computer readable medium can be, for example, without limitation an electronic, magnetic, optical, electromagnetic, infrared, or semiconductor system, or a propagation medium. Non-limiting examples of a computer readable medium include a semiconductor or solid state memory, magnetic tape, a removable computer diskette, a random access memory (RAM), a read-only memory (ROM), a rigid magnetic disk, and an optical disk. Optical disks may include compact disk-read only memory (CD-ROM), compact disk-read/write (CD-R/W), and DVD.

Further, a computer usable or computer readable medium may contain or store a computer readable or computer usable program code such that when the computer readable or computer usable program code is executed on a computer, the execution of this computer readable or computer usable program code causes the computer to transmit another computer readable or computer usable program code over a communications link. This communications link may use a medium that is, for example without limitation, physical or wireless.

A data processing system suitable for storing and/or executing computer readable or computer usable program code will include one or more processors coupled directly or indirectly to memory elements through a communications fabric, such as a system bus. The memory elements may include local memory employed during actual execution of the program code, bulk storage, and cache memories which provide temporary storage of at least some computer readable or computer usable program code to reduce the number of times code may be retrieved from bulk storage during execution of the code.

Input/output or I/O devices can be coupled to the system either directly or through intervening I/O controllers. These devices may include, for example, without limitation, keyboards, touch screen displays, and pointing devices. Different communications adapters may also be coupled to the system to enable the data processing system to become coupled to other data processing systems or remote printers or storage devices through intervening private or public networks. Non-limiting examples of modems and network adapters are just a few of the currently available types of communications adapters.

The description of the different illustrative embodiments has been presented for purposes of illustration and description, and is not intended to be exhaustive or limited to the embodiments in the form disclosed. Many modifications and variations will be apparent to those of ordinary skill in the art. Further, different illustrative embodiments may provide different features as compared to other illustrative embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

What is claimed is:

1. A vocal feedback apparatus to assist a user with uttering an intended frequency, comprising:

an input signal derived from a user's utterance and received by a fundamental frequency accentuator, where the user's utterance is determined by the user and corresponds to an intended fundamental frequency;

a detected fundamental frequency determined from the input signal by the fundamental frequency accentuator; and an output signal generated by the fundamental frequency accentuator, where the output signal contains the detected fundamental frequency and is continually adjusted by the fundamental frequency accentuator in response to changes in the detected fundamental frequency;

wherein the output signal is receivable by the user and the user adjusts the user's utterance based on a difference perceived by the user between the intended fundamental frequency and the detected fundamental frequency.

2. The vocal feedback apparatus of claim 1, further comprising an accentuated fundamental frequency created from the detected fundamental frequency by the fundamental frequency accentuator and where the output signal corresponds to the accentuated fundamental frequency.

3. The vocal feedback apparatus of claim 2, wherein a ratio of an amplitude of the accentuated fundamental frequency to other frequencies of the output signal is greater than a ratio of an amplitude of the detected fundamental frequency to other frequencies of the input signal.

4. The vocal feedback apparatus of claim 1, wherein the fundamental frequency accentuator comprises:

a frequency discriminator configured to detect the fundamental frequency of the user's utterance;

a device configured to process the user's utterance, the device comprising at least one of:

a filter connected to the frequency discriminator and configured to filter the detected fundamental frequency; or a synthesizer connected to the frequency discriminator and configured to synthesize a tone of the detected fundamental frequency; and wherein the output signal is transmitted by one of the filter or the synthesizer.

5. The vocal feedback apparatus of claim 4, wherein the device is the filter and the filter is a tunable low-pass filter or band-pass filter having a cutoff frequency or a band-pass frequency range determined from the detected fundamental frequency.

6. The vocal feedback apparatus of claim 3, wherein the device is the filter and wherein the filter automatically adjusts a cutoff frequency or a band-pass frequency range based on the detected fundamental frequency.

7. The vocal feedback apparatus of claim 3, wherein the device is the filter and wherein the filter is configured to attenuate distracting harmonics from a spectrum of frequencies of the user's utterance.

8. The vocal feedback apparatus of claim 3, wherein the device is the synthesizer and wherein the synthesizer is further configured to mute the output signal when no fundamental frequency of the user's utterance is detected.

9. The vocal feedback apparatus of claim 3, further comprising an output transducer configured to receive the output signal and emit an audio signal of the accentuated fundamental frequency to be heard by the user.

10. The vocal feedback apparatus of claim 3, wherein the frequency discriminator and the device are integrated and comprise:

a bank of multiple low-pass or band-pass filters covering a frequency range configured to drive a discrimination circuit; and a multiplexer configured to select output from the bank of multiple low-pass or band-pass filters and transmit the output signal.

11. A self-adjusting fundamental frequency accentuation natural ear apparatus, comprising:

an input transducer configured to generate an input signal from an utterance;

a fundamental frequency discriminator configured to detect a fundamental frequency in the input signal and transmit a detected voice frequency signal;

a device configured to accentuate the detected fundamental frequency and generate an output signal containing the accentuated fundamental frequency; and an output transducer configured to generate sound corresponding to the accentuated fundamental frequency;

wherein the device automatically adjusts the accentuated fundamental frequency if the detected voice frequency changes as a result of a change in the utterance.

12. The apparatus of claim 11, wherein the device is a filter having an automatically adjustable cutoff frequency based on the detected voice frequency signal and the input signal.

13. The apparatus of claim 11, wherein the device is a filter having a cutoff frequency based on the detected voice frequency signal and the input signal and configured to attenuate frequencies other than the detected fundamental frequency.

14. The apparatus of claim 11, wherein the device is a synthesizer that dynamically generates a tone at the detected fundamental frequency.

15. A method for accentuating a fundamental frequency of a user's utterance, comprising:

receiving an input signal at a fundamental frequency discriminator, where the input signal corresponds to the user's utterance;

detecting a fundamental frequency of the user's utterance from the input signal using the fundamental frequency discriminator;

accentuating the detected fundamental frequency of the user's utterance;

transmitting an output signal containing the accentuated fundamental frequency to an output transducer;

producing sound from the output transducer corresponding to the accentuated fundamental frequency, where the sound is heard by the user; and adjusting the accentuated fundamental frequency if the detected fundamental frequency changes as a result of a change in the user's utterance.

16. The method of claim 15, wherein accentuating the detected fundamental frequency comprises filtering the input signal to attenuate frequencies other than the detected fundamental frequency.

17. The method of claim 15, wherein accentuating the detected fundamental frequency comprises:

filtering the input signal to attenuate frequencies other than the detected fundamental frequency; and automatically adjusting the cutoff frequency of the filter based on the detected fundamental frequency.

18. The method of claim 15, wherein accentuating the detected fundamental frequency comprises synthesizing a tone at the detected fundamental frequency.

19. The method of claim 15, wherein accentuating the detected fundamental frequency comprises:

synthesizing a tone at the detected fundamental frequency; and automatically adjusting the synthesized tone based on changes in the detected fundamental frequency.

20. The method of claim 15, where the user determines an intended fundamental frequency ($F_i$), the method further comprising adjusting the user's utterance to reduce a difference between the intended fundamental frequency ($F_i$) and the accentuated fundamental frequency.

* * * * *